US008678101B2

(12) United States Patent
Gatsonides et al.

(10) Patent No.: US 8,678,101 B2
(45) Date of Patent: Mar. 25, 2014

(54) FIRE SUPPRESSION SYSTEM WITH PRESSURE REGULATION

(75) Inventors: Josephine Gabrielle Gatsonides, Dunstable (GB); Robert G. Dunster, Slough (GB)

(73) Assignee: Kidde Technologies, Inc., Wilson, NC (US)

( * ) Notice: Subject to any disclaimer, the term of this patent is extended or adjusted under 35 U.S.C. 154(b) by 949 days.

(21) Appl. No.: 12/721,893

(22) Filed: Mar. 11, 2010

(65) Prior Publication Data

US 2011/0048747 A1 Mar. 3, 2011

(51) Int. Cl.

| | |
|---|---|
| ***A62C 3/07*** | (2006.01) |
| ***A62C 3/08*** | (2006.01) |
| ***A62C 35/00*** | (2006.01) |

(52) U.S. Cl.

USPC ..... 169/62; 169/61; 169/60; 169/20; 169/16; 169/8

(58) Field of Classification Search

USPC ..... 169/8, 16, 20, 61, 62, 60

See application file for complete search history.

(56) References Cited

U.S. PATENT DOCUMENTS

| | | | | |
|---|---|---|---|---|
| 4,281,717 | A | 8/1981 | Williams | |
| 4,305,469 | A * | 12/1981 | Morrisette | 169/61 |
| 4,351,394 | A | 9/1982 | Enk | |
| 4,356,868 | A * | 11/1982 | Bentley et al. | 169/26 |
| 4,566,542 | A | 1/1986 | Enk et al. | |
| 5,673,755 | A * | 10/1997 | Sundholm | 169/16 |
| 5,857,525 | A | 1/1999 | Okamoto et al. | |
| 6,029,751 | A | 2/2000 | Ford et al. | |
| 6,676,081 | B2 * | 1/2004 | Grabow et al. | 244/129.2 |
| 7,066,274 | B2 * | 6/2006 | Lazzarini | 169/54 |
| 2000/5021787 | | 10/2005 | Reynolds | |
| 2008/0105442 | A1 | 5/2008 | Reilly et al. | |
| 2008/0290216 | A1 | 11/2008 | Lessi et al. | |

FOREIGN PATENT DOCUMENTS

| | | |
|---|---|---|
| EP | 0170749 | 2/1986 |
| EP | 2233175 | 9/2010 |
| EP | 2233175 A1 | 9/2010 |
| GB | 338197 A | 11/1930 |
| GB | 1479432 A | 7/1977 |
| GB | 2424184 A | 9/2006 |
| JP | 2009005719 | 1/2009 |
| WO | 0041769 A1 | 7/2000 |
| WO | 2007032764 A1 | 3/2007 |

OTHER PUBLICATIONS

GB Combined Search and Examination Report for GB Application No. GB1210154.9 completed Oct. 4, 2012.

European Search Report dated Dec. 8, 2010.

GB Combined Search and Examination Report for GB Application No. GB1210154.9 completed Aug. 15, 2013.

* cited by examiner

*Primary Examiner* — Dinh Q Nguyen

(74) *Attorney, Agent, or Firm* — Carlson, Gaskey & Olds, PC

(57) ABSTRACT

A fire suppression system includes a container for supplying a fire suppression agent into a compartment to be protected. The container communicates with a flow line leading to the compartment. A control controls the fire suppression system, and a valve on the flow line delivers a variable pressure to the flow line from the container. Further, a system is disclosed and claimed wherein a single gas supply communicates through a manifold to each of a plurality of compartments. In addition, a system is disclosed and claimed wherein a primary gas supply container switches to secondary gas supply containers once a pressure within the primary gas supply container drops below a predetermined amount.

15 Claims, 2 Drawing Sheets

FIRE SUPPRESSION SYSTEM WITH PRESSURE REGULATION

RELATED APPLICATION

This application claims priority to GB 0915123.4, which was filed Aug. 27, 2009.

BACKGROUND

This application relates to a fire suppression system wherein a gas is directed into a compartment at a controlled pressure.

Fire suppression systems are known, and are often used in aircraft, buildings, or other structures having contained areas. As an example, an aircraft is typically provided with a fire suppression system that can direct Halon into a compartment where a fire has been detected. The goal is to discharge an effective suppressing agent concentration into the compartment such that the fire will be suppressed before there is significant damage. Aircraft cargo systems, electronic bays, and other compartments may include such a system.

In general, such systems have a first high rate discharge unit utilized initially to bring in a sufficiently high agent concentration into the compartment. After expiration of a period of time, then the system switches to a lower rate discharge unit to maintain the demanded inerting concentration in the compartment.

Halon use has been prohibited by the Montreal Protocol except for critical use areas. The airplane industry is one of the last remaining industries still with a critical use exemption. Halon 1301 production has been banned in developed countries since 1994. Recently, there have been proposals to replace Halon as the fire suppression agent. Finding an acceptable alternative, both in performance and space/weight issues is beginning to be an issue of concern, as Halon supplies and time are running out.

Proposals have been made to utilize inert gas, as an example.

Aircraft manufacturers desire weight reduction, and other Halon replacement options (HFC's etc) have too high a weight penalty. Candidate systems for Halon replacement showing equally good fire suppression performance have such a significantly higher weight compared to Halon systems, such that environmental benefits are outweighed by the additional fuel required.

SUMMARY

A fire suppression system includes a container for supplying a fire suppression agent into a compartment to be protected. The container communicates with a flow line leading to the compartment. A control controls the fire suppression system, and a valve on the flow line delivers a variable pressure to the flow line from the container.

Further, a system is disclosed and claimed wherein a single gas supply communicates through a manifold to each of a plurality of compartments.

In addition, a system is disclosed and claimed wherein a primary gas supply container switches to secondary gas supply containers once a pressure within the primary gas supply container drops below a predetermined amount.

These and other features of the present invention can be best understood from the following specification and drawings, the following of which is a brief description.

DETAILED DESCRIPTION

Figure 1:
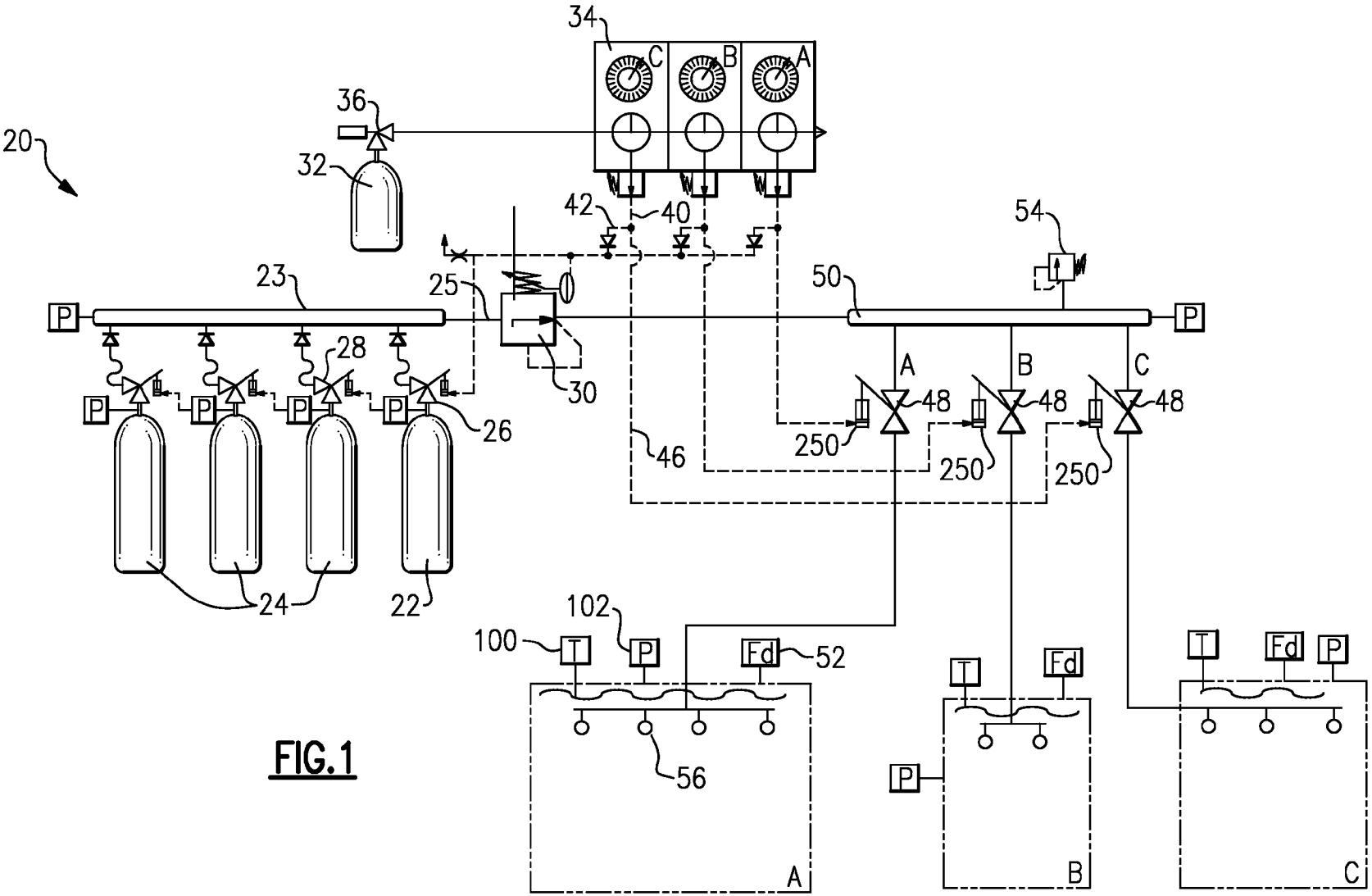
FIG. 1 shows a first embodiment.

A system 20 is illustrated in FIG. 1, and is to be mounted on a vehicle such as an aircraft. A primary gas container 22 includes a supply of an inert gas, or mixture of gases. Secondary gas containers 24 also include an inert gas or mixture. A valve 26 receives a control pressure from a pneumatic control 34. The container 22 communicates to a manifold 23 and a flow line 25 downstream of the manifold 23. Flow line 25 includes a pressure regulating valve 30 which is also controlled by the pneumatic control 34. A high pressure gas supply 32 supplies a control gas, which may be air, through a valve 36 to the control 34. The control 34 has flow lines 40 associated with valves 48 for each of zones A, B, and C, and a tap 42 for directing the control gas to the pressure regulating valve 30 to control the pressure delivered across the valve 30, and to each of the compartments A, B, and C, as illustrated in FIG. 1.

While a pneumatic control 34 is disclosed and controls each of the valves as described below pneumatically, other valve controls may be utilized such as hydraulic, mechanical or electronic controls.

The valve 26 is a toggle valve such that when the pressure within the primary container 22 drops below a predetermined amount, a valve 28 associated with the secondary container will then open the secondary container such that flow will then pass from the secondary container 24 to the manifold 23. This can happen serially with each of the plurality of secondary containers 24.

When a fire is detected within a compartment A, B, or C by a fire detector 52, a signal is sent to a control 34. A temperature sensor 100 and a pressure sensor 102 may also be incorporated into the compartments A, B, and C to provide additional control signals after the initial fire suppression. As an example, the pressure sensor 102 may sense a change in ambient pressure, and the temperature sensor 100 may sense an increase in average temperature in the protected area. Signals from these sensors can be utilized by the pneumatic control 34, which in turn can adjust the lower rate discharge until the fire risk is again under control.

Once a fire is detected in a compartment, compartment A for example, then the control 34 acts to open the container 22 at its valve 26, and deliver an inert gas through the valve 30, to a manifold 50, through a relay valve 48 associated with the compartment A, and delivers the inert gas to nozzles 56 within the compartment A. Compartment A may be, for example, a cargo compartment on an aircraft. Compartment B may be an electric bay, while compartment C may be an auxiliary power unit. The control 34 controls the relay valve 48 through a pneumatic chamber 250. Pneumatic chamber 250 receives its control signal from a tap 46.

When a fire is detected, inert gas is directed from the container 22 into the compartment A at a relatively high pressure, and thus at a relatively high rate. This high rate discharge is restricted to a very limited time, demanded to assure an effectively fast response to a fire threat, but without the risk of overfilling, which could cause damage by overpressurization of the compartment and excessive loss of suppressing agent. Thus, after the set period of time, at a pressure which is calculated to have allowed the inert gas or mixture of gases to safely fill the compartment A to the required concentration, then the control 34 may switch the valve 30 to a lower pressure mode of operation. This would be more of a "sustaining" mode that will ensure inert gas will continue to fill the compartment A at a lower rate, and replace any leaking inert gas to keep the compartment sufficiently inerted until the aircraft can land.

An over-pressure valve 54 is mounted on the manifold 50.

Figure 2:
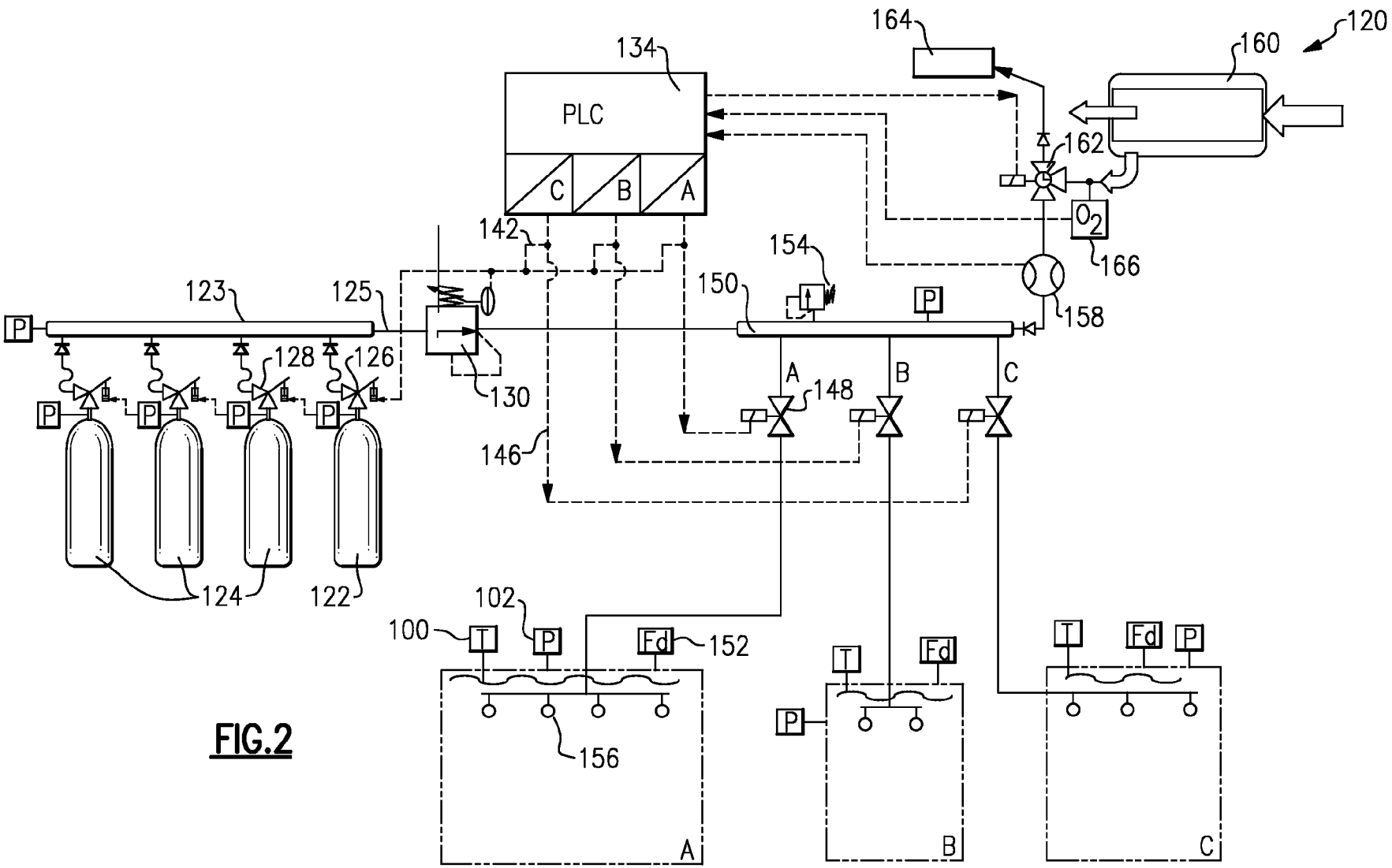
FIG. 2 shows a second embodiment.

FIG. 2 shows an alternative embodiment 120. Many components in the alternative embodiment 120 are similar to the embodiment 20, and include the same reference number, only with one-hundred added. Thus, the control 134 again operates to control the valve 130, and the relay valves 148.

However, in this embodiment, the manifold 150 also selectively receives a supply of nitrogen-enriched air from an onboard inert gas generation system 160. Such systems take in air, and provide a nitrogen-enriched air, such as to a fuel tank 164. This system incorporates a multi-way selector valve 162 which can selectively direct some, or all, of this gas through a flow meter 158, and into the manifold 50. Thus, this system will allow the use of nitrogen-enriched air in combination with the inert gas, particularly in the low pressure mode of operation as described above, which is entered as a "sustaining" mode. In addition, a oxygen analyzer 166 is provided to ensure there is not too much oxygen in this supply of air. In this embodiment, once the nitrogen-enriched air is directed into the compartment in the maintenance mode, the flow from the primary containers may be stopped entirely by the valve 130.

At any time, should the control 134 determine that the nitrogen-enriched air is not sufficient for maintenance mode, then the valve 130 may be again reopened.

There are many benefits to the combined system, and several of the disclosed features do operate synergistically in combination with each other. As an example, having a pressure regulated valve 30/130 delivering the agent to the manifold 50, allows a single manifold, flow valve, and containers 22/24 to supply suppression to each of the compartments A, B, and C, irrespective of the different demands for high rate discharge or low rate discharge caused by volume or leakage of the specific compartment. The valve 30/130 can accurately control the amount of gas delivered to the protected area. Previous separate systems were needed for the high rate discharge and low rate discharge per protected compartment/volume.

In addition, the system is very amenable to modular construction. The modular construction allows the suppression system to be easily adapted or reconfigured according to changed aircraft deployment or reconfiguration of the cargo compartments.

The containers 22/24/122/124 can be formed of lightweight fiber reinforced materials. The manifolds and valves can be formed of ceramic materials.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A fire suppression system incorporating:

a container for supplying a fire suppression agent into a compartment to be protected, said container communicating with a flow line for leading to the compartment;

a control for controlling the fire suppression system, and a valve on said flow line, and said control controlling said valve to deliver a variable pressure to said flow line from said container;

said control initially delivers a high pressure to said line for a period of time, and then switches to a lower pressure for a maintenance period after expiration of said period of time; and said control receiving feedback of at least one of a pressure and temperature associated with a compartment, after the control has switched to the lower pressure, and selectively moving back toward higher pressures based upon said feedback.

2. The system as set forth in claim 1, wherein said container includes a plurality of containers, and there is a valve associated with a main container that switches to a secondary container when a pressure within said main container drops below a predetermined amount.

3. The system as set forth in claim 2, wherein said switch from said main container to said secondary container is provided by a pneumatic control.

4. The system as set forth in claim 1, wherein said control is a pneumatic control.

5. The system as set forth in claim 1, wherein said flow line communicates with a manifold, and said manifold communicating with a plurality of compartments, with each of said plurality of compartments having a relay valve to control the flow of agent from said manifold into each individual compartment.

6. The system as set forth in claim 5, wherein said relay valves are actuated by a pneumatic control when a fire is detected in an associated compartment.

7. The system as set forth in claim 1, wherein a nitrogen enriched gas is generated and supplied into the compartment after expiration of a period of time.

8. The system as set forth in claim 7, wherein a generator for generating nitrogen enriched gas communicates with a flow valve, said nitrogen enriched gas normally being directed to a fuel tank associated with a vehicle receiving the fire suppression system, and said valve switching the delivery of at least a portion of said nitrogen enriched gas into the compartment.

9. The system as set forth in claim 1, wherein said system is associated with an aircraft.

10. The system as set forth in claim 1, wherein a single valve delivering flow from a single container during both said high pressure and after switching to said lower pressure.

11. The system as set forth in claim 1, wherein selective movement back toward said higher pressure may occur should said control receive feedback in a change of pressure or an increase in temperature in a protected area.

12. The system as set forth in claim 11, wherein said feedback is an increase in average temperature in the protected area.

13. The system as set forth in claim 11, wherein the movement back toward said higher pressure is maintained until a fire risk is under control.

14. The system as set forth in claim 11, wherein the feedback is provided from at least one of a pressure and temperature sensor.

15. The system as set forth in claim 14, wherein there is a sensor for both pressure and temperature in said compartment.

* * * * *